US007210595B2

(12) United States Patent
Smith

(10) Patent No.: US 7,210,595 B2
(45) Date of Patent: May 1, 2007

(54) STORAGE DEVICE

(75) Inventor: Ray Smith, Cornwall (GB)

(73) Assignee: Spin Master Ltd., Toronto, Ontario ( * ) Notice: Subject to any disclaimer, the term of this patent is extended or adjusted under 35 U.S.C. 154(b) by 543 days.

(21) Appl. No.: 10/728,096

(22) Filed: Dec. 5, 2003

(65) Prior Publication Data

US 2004/0155038 A1 Aug. 12, 2004

(30) Foreign Application Priority Data

Dec. 13, 2002 (GB) ..... 0229178.9

(51) Int. Cl.
*B65D 6/16* (2006.01)

(52) U.S. Cl. ..... 220/9.4

(58) Field of Classification Search ..... None
See application file for complete search history.

(56) References Cited

U.S. PATENT DOCUMENTS

| | | | | |
|---|---|---|---|---|
| 400,588 A | | 4/1889 | Meyering | |
| 1,206,618 A | * | 11/1916 | Thrasher et al. | 220/6 |
| 2,150,620 A | | 3/1939 | Frost | |
| 6,089,394 A | * | 7/2000 | Ziglar | 220/6 |
| 6,102,569 A | | 8/2000 | Wang | |
| 6,669,045 B2 | * | 12/2003 | Wang | 220/9.2 |

FOREIGN PATENT DOCUMENTS

| | | |
|---|---|---|
| EP | 1 004 514 A | 5/2000 |
| EP | 1136376 A1 | 9/2001 |
| GB | 2377691 A | 1/2003 |
| JP | 2000-211702 A | 8/2000 |
| WO | WO03101853 A | 12/2003 |

* cited by examiner

*Primary Examiner*—Stephen J. Castellano
(74) *Attorney, Agent, or Firm*—Cohen Pontani Lieberman & Pavane LLP

(57) ABSTRACT

A storage device is provided which includes at least first and second frames and a plurality of support members for maintaining the first and second frames at a spaced distance apart. The support members and frames define the shape of the storage device, and sheet material depends between the first and second frames and the support members to form side walls of the device. The device is movable between a flattened condition and an erect condition by user manipulation of the frames. This user manipulation includes rotating the frames relative to each other to twist the device and move the device between the flattened and erected conditions. When the device is in the collapsed or erect conditions, the support members are substantially straight.

18 Claims, 9 Drawing Sheets

STORAGE DEVICE

This invention relates to a storage device, and particularly to a storage device which is movable between an in use condition and a storage condition.

Storage devices which are capable of being moved between an in use condition and a storage condition are known. An example of one such storage device is disclosed in U.S. Pat. No. 6,431,393 and comprises a resilient coiled frame having sheet material located therebetween to form the side walls of the device. An opening is provided in the top of the device so that items can be located therein. The resilient frame biases the device to an erect in use condition. In order to move the device to a collapsed storage condition, the device is flattened by applying pressure in a downwardly direction on the top surface of the device to overcome the resilient bias of the coiled frame. Other similar devices are disclosed in GB2336520, U.S. Pat. No. 2,150,620 and U.S. Pat. No. 400,588 but these devices typically require a twisting action to be imparted to portions of the device to move the devices between collapsed and erected positions.

Problems associated with these types of devices are that the resilient frame means are expensive to manufacture and assemble and the devices are required to have securing means to maintain the devices in a collapsed storage condition, typically due to the resilience of the frame means and/or one or more support members provided between the frame means.

It is an aim of the present invention to provide a storage device having an alternative means of moving the device between flattened and erect conditions.

It is a further aim of the present invention to provide a storage device which overcomes the abovementioned problems.

According to a first aspect of the present invention there is provided a storage device, said storage device including at least first and second frame means and one or more support members for maintaining said at least first and second frame means at a spaced distance apart, said support member(s) and frame means defining the shape of the storage device, and sheet material depending between said at least first and second frame means and/or said one or more support members forming at least side walls of the device, said device movable between a flattened/collapsed condition and an erect condition by user manipulation of said frame means, said user manipulation including rotating at least one of said frame means relative to another of said frame means to twist the device and move the device between said flattened/collapsed and erect conditions, and wherein when the device is in the flattened/collapsed or erected conditions, the support members are substantially straight.

Since the support members are substantially straight in both the flattened and erect conditions, there is no requirement for additional means to be provided to maintain the device in either condition.

Preferably the frame means is rotated/twisted about a substantially central axis thereof.

The at least first and second frame means can be rotated in a substantially opposite direction to each other or one of the frame means can be held in a stationary position and the other frame means rotated relative thereto.

Preferably the one or more support members are formed from a flexible material to allow flexing or bending thereof when one of the frame means is rotated relative to another of said frame means.

Further preferably the support members are formed from any or any combination of glass fibre, plastic or metal material. Preferably at least the ends of the support members are located in channels and/or pockets on the device. When the device is an erect condition, the channels and/or pockets are spaced a sufficient distance apart to allow a support member to be substantially straight.

In order for the support members to be substantially straight when the device is in the erect or collapsed conditions, when a frame means is rotated relative to another frame means, the distance between the pockets or channels housing at least the ends of each support member located between the frame means is initially reduced. This causes each support member to be placed under increased compression/tension (compression on one side of the support member and tension on the other side), typically causing the support member to bend or flex. Further rotation action causes the distance between the pockets or channels to again increase, thereby causing the support member to straighten and resulting in the portion of the device between the frame means to be moved from the erect to collapsed condition or vice versa.

Preferably the ratio of the length of the support member and spacing of the pockets or channels for housing at least the ends of the support member is such that the support member is caused to be placed under increased compression/tension on initial twisting or rotation of the frame means and then reduced compression/tension as subsequent increased or decreased twisting of the device takes place until the point where the device is fully erect or fully collapsed.

In one embodiment a whole or a substantial part of the one or more support members is located in a channel or pocket in the device.

Preferably the channel or pocket is formed from sheet material, and further preferably from the sheet material forming the side walls of the device.

Further preferably the channel or pockets housing the ends of a support member are located adjacent respective frame means which are required to be manipulated relative to each other in order to move the device between erect and flattened conditions.

The support members are typically elongate but can be of any size, width and/or length. In a preferred embodiment the support members are in the form of rods.

In one embodiment the at least first and second frame means form the base and top of the device. In this embodiment the support members form the side walls of the device.

Preferably the support members are arranged in a substantially vertical orientation.

In an alternative embodiment the at least first and second frame means form one or more side walls of the device. In this embodiment the one or more support members form the top and/or base of the device.

Preferably the support members are arranged in a substantially horizontal orientation.

In one embodiment at least one of said first and second frame means is in the form of a panel. The panel may or may not have sheet material covering the same and can be substantially rigid if required.

Preferably an aperture or opening is defined in the panel to allow one or more items to be located in the device.

In a further embodiment at least one of said first and second frame means is in the form of a frame member, such as an enclosed loop.

In either embodiment, the at least first and second frame means are typically substantially rigid, thereby providing rigidity to the device and allowing manipulation of the same without the frame means collapsing.

In a yet further embodiment the one or more support members provide support to the top, base and/or side walls of the device in addition to the frame members. Thus, for example, the base of the device can be defined by at least one frame member and at least one support member, the support member being positioned between two locations on the frame member, thereby providing the frame member with increased strength.

The sheet material moves with the frame means and/or support member(s) between said flattened and erect conditions.

Preferably the sheet material depending between said at least first and second frame means and/or support members forms substantially planar walls of the structure.

In one embodiment the storage device is provided with closure means to close one or more apertures or openings provided in the device.

In one embodiment the closure means include one or more sub frame members.

Preferably the sub frame members are movable independently of said at least first and second frame means and/or support members.

The sheet material can be attached to the support members and/or frame means by stitching, hooks, adhesive, VELCRO and/or the like, thereby allowing the sheet material to follow the movement of the rod or frame members.

In one embodiment two or compartments are formed in the device. The compartments are typically defined by sheet material attached between one or more support members and/or frame members.

In a further embodiment of the present invention, the storage device is provided with at least three frame means defining at least two sections in the device. Each section of the device is typically collapsed independently of the other section(s), thereby allowing the size of the device to be changed according to the space available and the number of items required to be stored in the device.

In order to collapse a section/part or all of the device, one frame means is twisted relative to one of the other frame means, typically the nearest frame means defining the section, thereby causing said section to collapse and fold. The third and or further frame means can then be twisted relative to the frame means of the collapsed first section to collapse the second section and so on, with further spaced frame means.

In a yet further embodiment of the present invention, the storage device is provided with engagement means for engaging two or more of the storage devices together. For example, the engagement means can include VELCRO, straps, hinges, clips and/or the like.

In a further aspect of the present invention there is provided a device having a central cavity defined by first and second frame members, said frame members spaced apart by a series of support members with their ends positioned at the respective peripheries of the frame members, said device movable between erect and storage conditions and wherein the support members with the device in the erect condition lie substantially perpendicular to the frame members and relative rotation of the frame members causes a twisting action on the support members and hence moves the frame members to the storage condition in which they are adjacent and parallel to each other.

Preferably the support members are substantially straight in either condition.

According to a yet further aspect of the present invention there is provided a method of moving a storage device between flattened and erect conditions, said storage device including at least first and second frame means and one or more support members arranged so as to maintain said at least first and second frame means a spaced distance apart when in an erect condition and for defining the shape of the storage device, said device further provided with sheet material depending between said frame means and/or support members and wherein said method includes the steps of rotating at least one of said first and second frame means relative to the other of said frame means to twist at least a portion of the device between said frame means, said rotation occurring in a first direction for moving the device to a flattened condition and in an opposite direction for moving the device to an erect condition, the support members being substantially straight in the erect or flattened conditions.

According to a further aspect of the present invention there is provided a storage device, said storage device including at least first and second frame means and one or more support members for maintaining said at least first and second frame means a spaced distance apart, said support member(s) and frame means defining the shape of the storage device, and sheet material depending between said at least first and second frame means and/or said one or more support members forming at least side walls of the device, said device movable between a flattened condition and an erect condition by user manipulation of said frame means and wherein at least one of said at least first and second frame means is required to be rotated relative to the other of said frame means to twist the device and move the device between said flattened and erect conditions and at least one of said first and second frame means comprises an enclosed loop frame.

Embodiments of the present invention will now be described with reference to the following drawings wherein:

FIG. 1*a* is a perspective view of a storage device according to an embodiment of the present invention in a fully erect condition;

FIGS. 1*b*–1*f* show the different stages involved in moving the storage device in FIG. 1*a* to a flattened condition;

FIG. 1*g* is a plan view of the storage device in FIG. 1*a* in a flattened condition;

FIGS. 2*a*–2I illustrate different embodiments of the present invention;

Figure 1A:
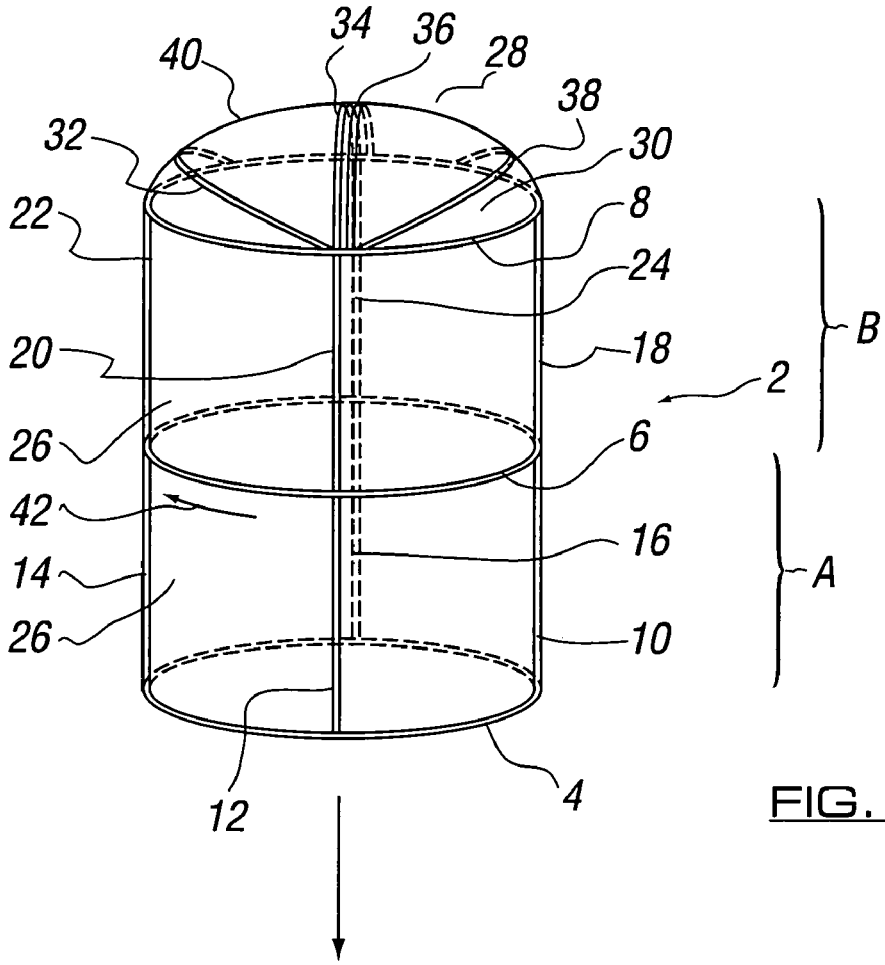

Referring firstly to FIGS. 1*a*–1*g*, there is illustrated a storage device 2 which can be manipulated between an erect in use condition and a flattened storage condition.

The storage device 2 comprises frame members 4, 6, 8 and rod members 10, 12, 14, 16 located between frame members 4 and 6 to define the first section 'A' of the device, and rod members 18, 20, 22 and 24 located between frame members 6 and 8 to define a second section 'B' of the device.

The frame members in this described embodiment are circular loops and the length of the rod members are substantially equal to the diameter of the frame members. However, the rod members can be greater, equal to or less than the diameter or cross section of the shape defined by the frame members.

Sheet material 26 depends between frame member 4 to form the base of the device and between the rod members and frame members to form the side walls of the device. The sheet material is typically provided with channels to allow the insertion of the members therein, thereby providing an improved aesthetic appearance and preventing the rod and frame members from being damaged or obstructed during movement or storage. However, it will be appreciated that the members can be located adjacent the sheet material and be provided internally or externally of the device.

The sheet material is typically a hard wearing flexible plastic or fabric material.

The arrangement of the frame and rod members and the sheet material provides a compartment in said device when in an erect condition in which one or more items can be stored.

Figure 4A:
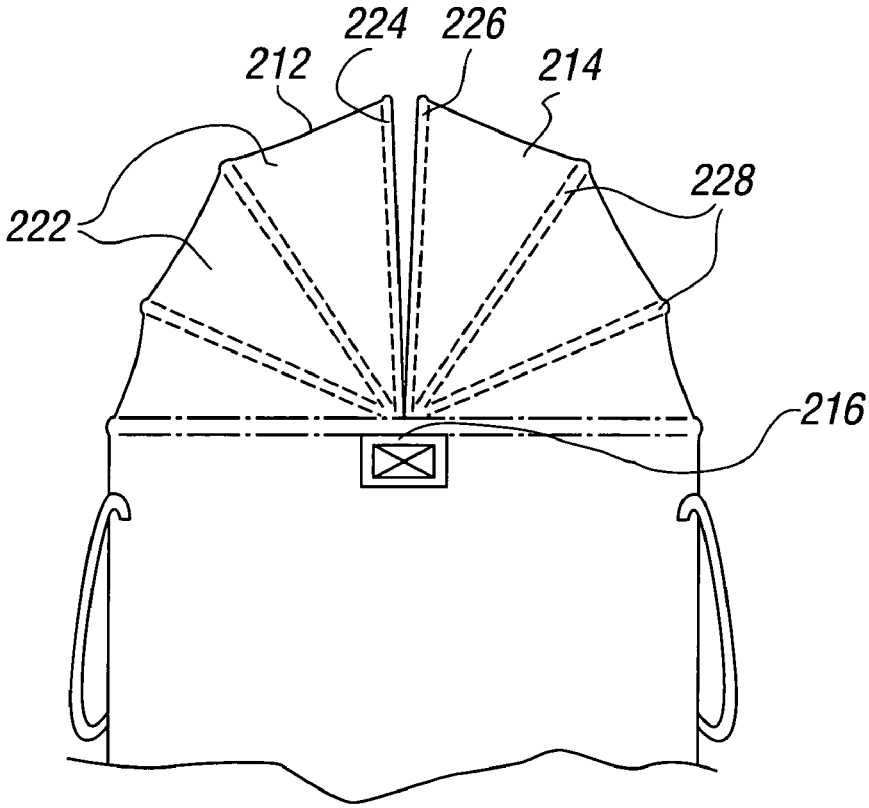
FIGS. 4A and 4B show a detailed view of the closure means according to an embodiment of the present invention.
Figure 4B:
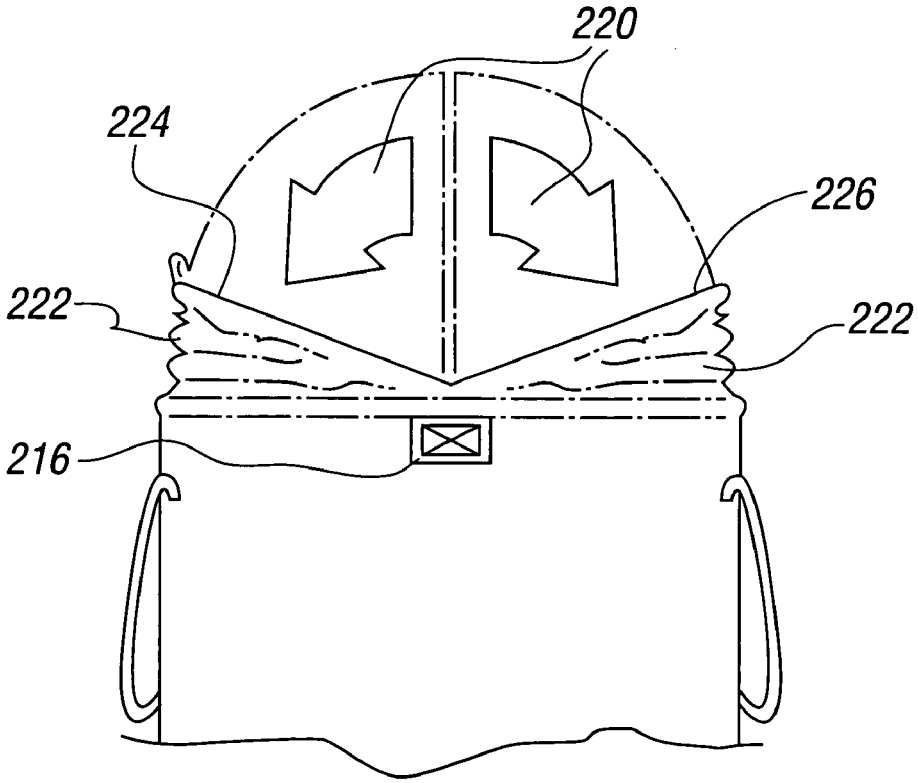

The device 2 is further provided with closure means 28 for closing an opening 30 of said device. The closure means in this embodiment comprises sub frame members 32, 34, 36 and 38. Sheet material 40 is located between the sub-frame members and said members and said sheet material are pivotally movable between a closed position, as shown in FIGS. 1*a* and 4*a* and an open position, as shown in FIG. 4*b*.

The frame members are typically made from a substantially rigid material to provide support and rigidity to the storage device. The rod members are typically provided of such dimensions to allow the device to be maintained in the erect condition yet be sufficiently flexible to allow the device to be manipulated between said erect condition shown in FIG. 1*a* and a completely flattened condition shown in FIG. 1*f*.

In order to collapse or flatten the device 2, as shown in FIGS. 1*a*–1*g*, a user first collapses lower part 'A' of device 2 by twisting or rotating frame member 6 relative to frame member 4, as shown by arrow 42. In this described embodiment, this rotational action is typically about the co-axis of the substantially circular frame members, and causes the relative twisting of the support members and the sheet material, to move the lower part 'A' to the collapsed condition.

Figure 1B:
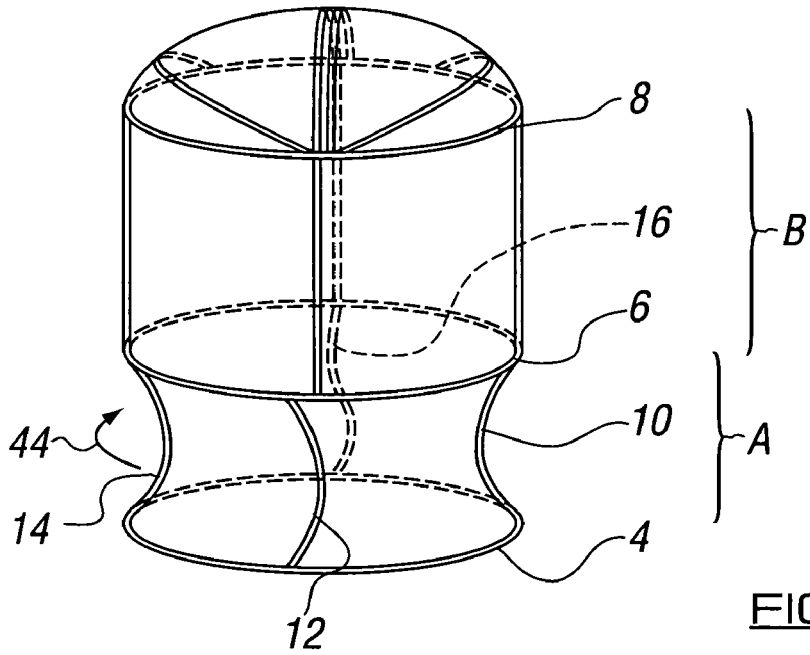

When the device is in a fully erect or flattened condition, the rod members are substantially straight, typically substantially vertical, and under little or no tension. Twisting of the frame members defining section 'A', as shown by arrow 44, causes the channels in which the rods are located to reduce in length (i.e. the ends of the channels are moved closer together), thereby causing the tension in the rods to increase and the rods to bend, as shown by FIG. 1*b*. Following continued rotation of the frame members, a point will be reached when the channels in which the rods are located increase in length (i.e. the ends of the channels are moved further apart), thereby releasing the tension in the rods and causing section 'A' to collapse without further manipulation being required. In moving the device from a collapsed to an erect condition, the process takes place in reverse.

Figure 1C:
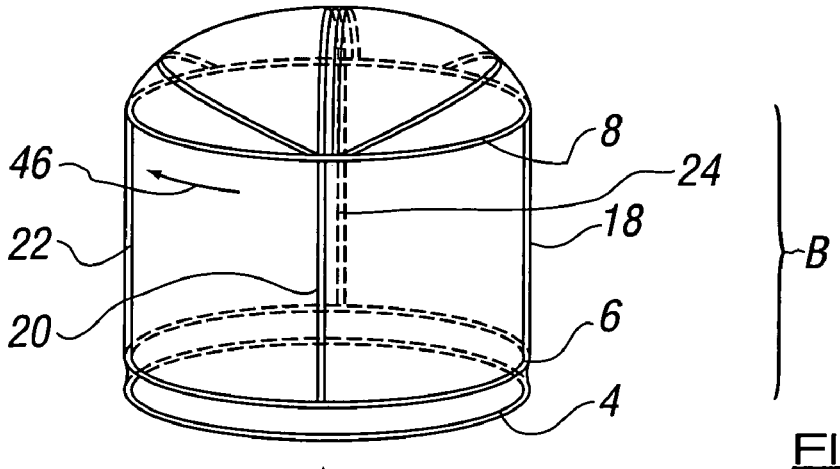

When section 'A' of the device is collapsed, the rod members straighten and lie in a partially overlapping arrangement, thereby bringing frame member 4 into a position adjacent frame member 6. Referring to FIG. 1*c*, once the lower part 'A' of the storage device has been collapsed frame member 8 can, if required, be rotated relative to frame member 6, as shown by arrow 46, to collapse upper part 'B' of device 2. This twisting action can be in the same or opposite direction to the twisting action used to collapse the lower part 'A'.

Figure 1D:
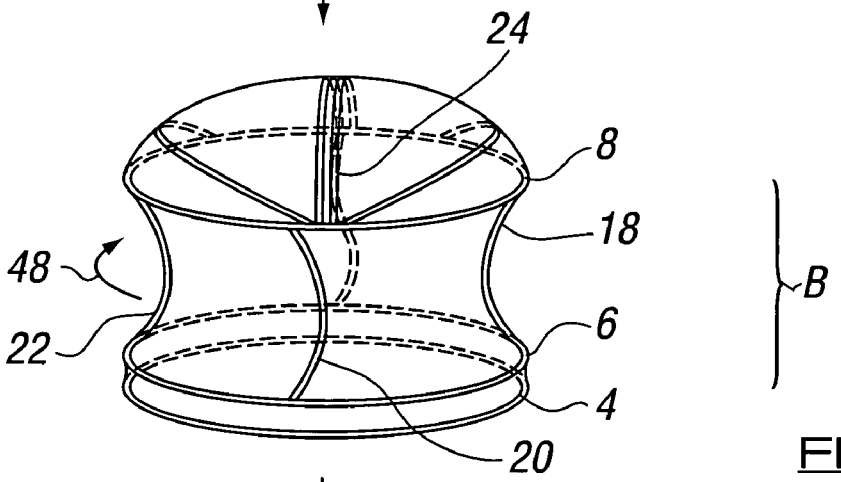
Figure 1E:
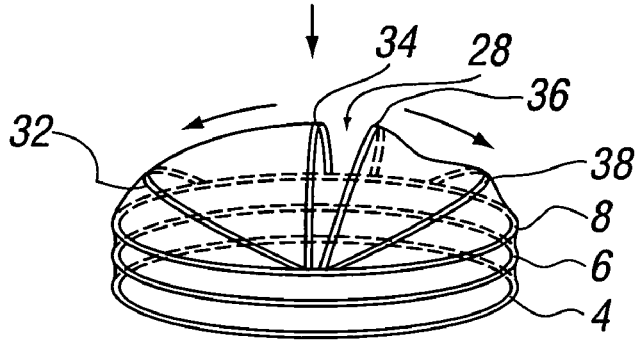

Continued bending of rod members 18, 20, 22, 24, due to the twisting action, as shown by arrow 48 and FIG. 1*d* causes said rods to straighten in a partially overlapping arrangement, thereby bringing frame member 8 into contact with frame member 6, as shown in FIG. 1*e*.

Figure 1F:
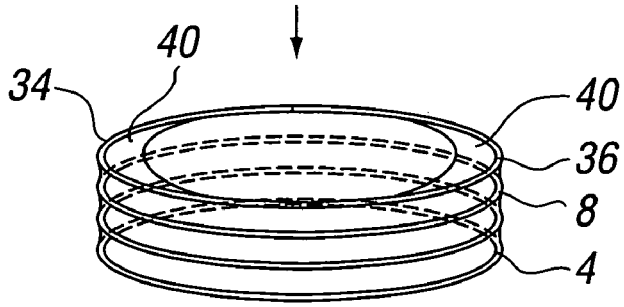

Closure means 28 can then be moved to a flattened condition by pivoting lead sub-frame members 34 and 36 from the closed position, wherein the lead sub frame members are adjacent and facing each other, to an open position, wherein the sub-frame members are spaced apart and adjacent frame member 8, as shown in FIG. 1*f*.

Figure 1G:
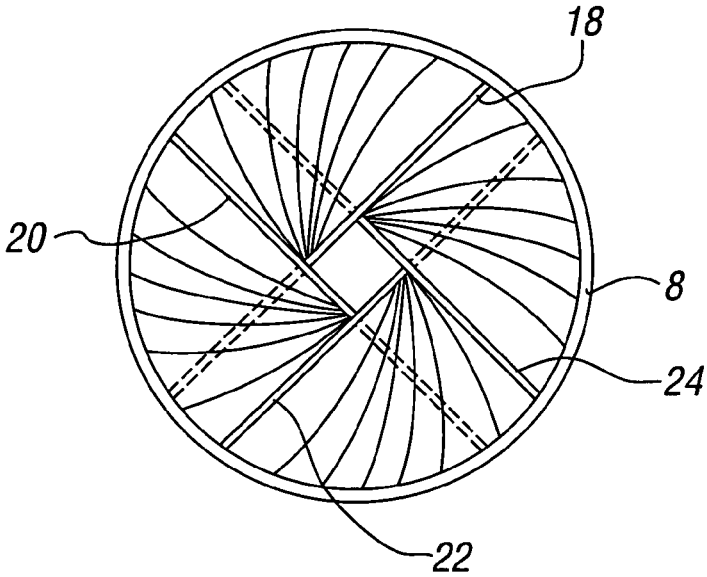

The final collapsed storage device is shown in plan view in FIG. 1*g*, with the sheet material folded to form pleats between the rod members.

The embodiment of the storage device described above is one example of a number of possible arrangements. Referring to FIGS. 2*a*–2l, examples of further storage devices in accordance with the present invention are shown.

Figure 2A:
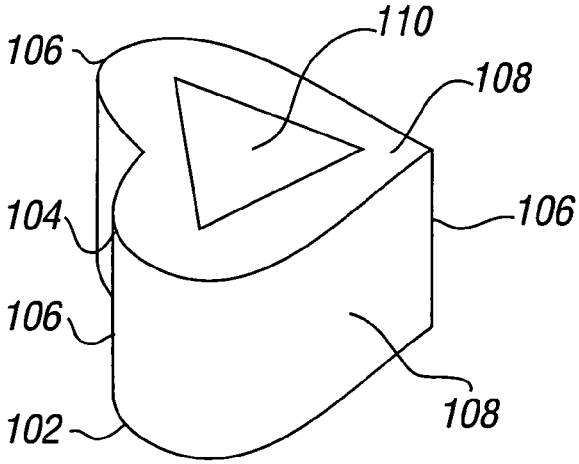

The first and second frame members 102, 104 are heart shaped, as shown in FIG. 2*a*, with rod members 106 separating said frame members and providing support for the side walls of the device. Sheet material 108 is provided between the frame members and rod members. An opening 110 is provided in the top surface of the storage device to allow one or more items to be placed therein.

Figure 2B:
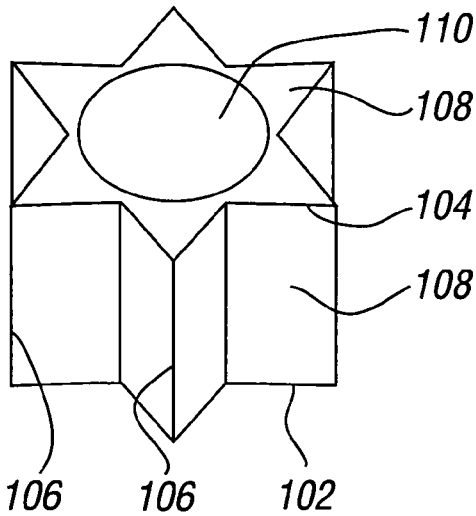
Figure 2C:
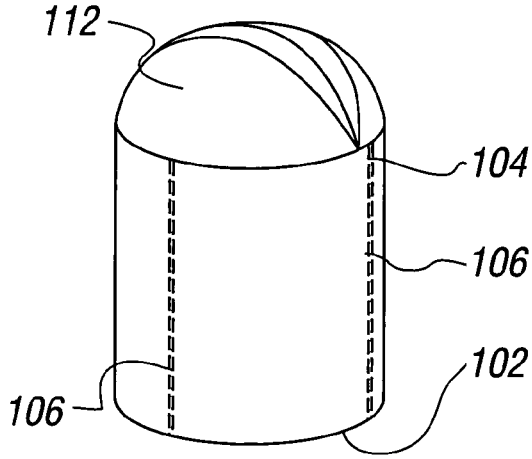

A similar arrangement is shown in FIG. 2*b* but the frame members are star shaped. A substantially cylindrical arrangement is shown in FIG. 2*c* and is similar to the storage device shown in FIGS. 1*a*–1*f* but only two frame members 102, 104 are provided. A hemispherically shaped closure 112 is provided over an opening in the device and operates in a similar manner to the closure 28 shown in FIG. 1*a*.

Figure 2D:
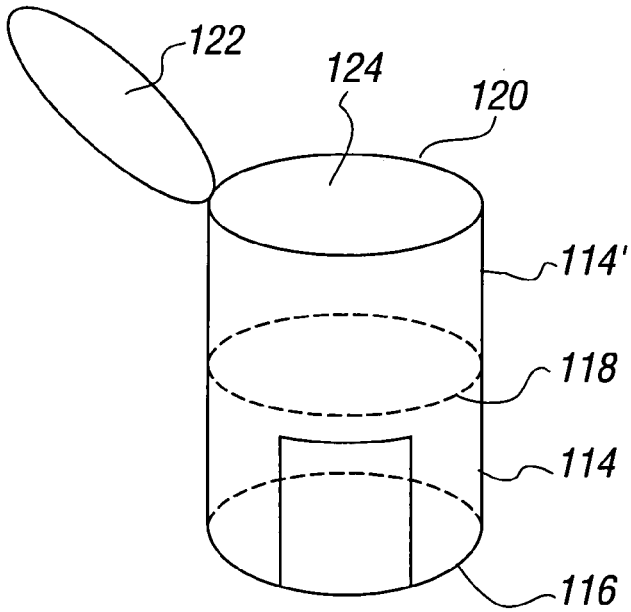

A further cylindrical storage device is shown in FIG. 2*d* comprising two tiers 114, 114' defined between three frame members 116, 118, 120. A closure in the form of a hinged lid 122 is provided to close opening 124.

Figure 2E:
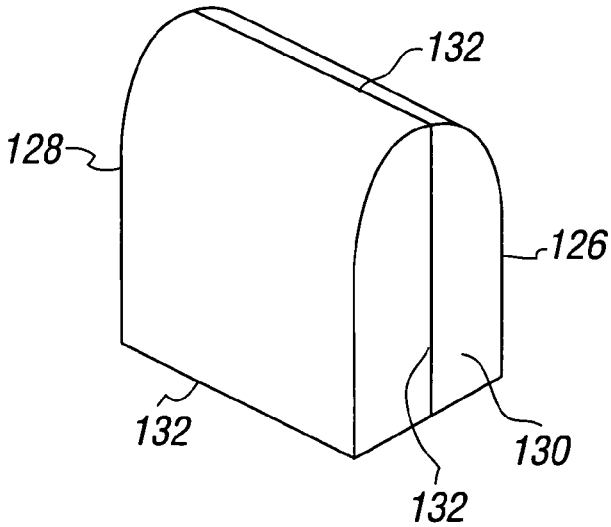
Figure 2F:
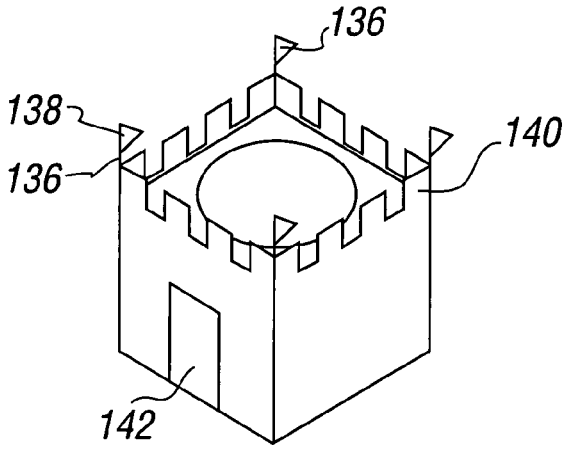
Figure 2G:
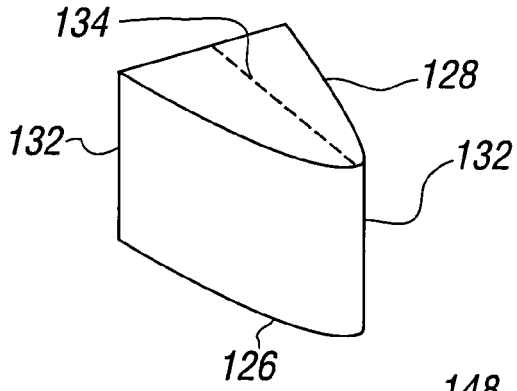
Figure 2H:
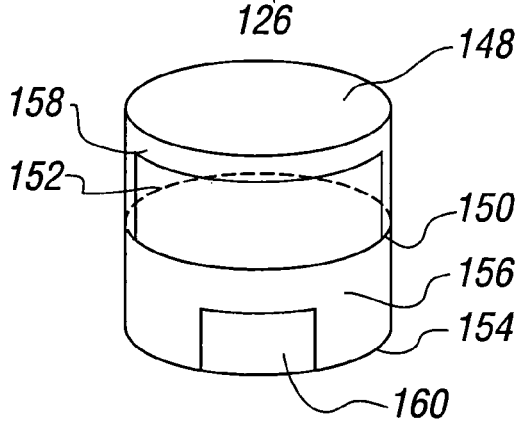

In FIG. 2*e*, the frame members 126, 128 of the device define the end walls 130 of the device. Rod members 132 are provided between each frame member in the end walls to provide strength and rigidity to the structure and/or can be provided between the frame members 126, 128 to form the top and/or base of the device. Alternatively, the device can be located in a different orientation such that the frame members 126, 128 form the top and base of the device and the rod members 132 form the side walls of the device, as shown in FIG. 2*g*. An opening can be provided in the sheet material at any suitable location on the device. For example, the opening can be provided with a zip closure 134 on one or more sides of the device, thereby allowing the device to be provided in one of a number of possible orientations, whilst allowing access to the interior of the storage device.

A number of further features can be provided on the storage device to improve the aesthetic appearance thereof. The further features can provide the storage device with the appearance of a character, person, monster, animal, building and/or the like. For example, in FIG. 2*f*, the storage device is formed to give the appearance of a castle with a plurality of smaller rod members 136 provided as flag poles, and sheet material 138 depending therefrom to form flags. A trim 140 is provided along an upper edge of the device to provide the appearance of castle walls. One or more designs can be printed onto the sheet material, such as a door 142 to improve the realism of the structure. An opening 144 can be provided at any suitable location on the structure for allowing one or more items to be located in the device.

The further features can be planar or non-planar features and may be provided with additional sub frames which can be moved between collapsed and erect conditions as required.

In a further embodiment of the present invention, sheet material can be provided between frame members or rod members within the interior of the device to provide one or more compartments therein. For example, in FIG. 2*h*, sheet material is provided between frame member 150, such that the space between frame member 148 and 150 defines a first compartment 152, and the space between frame member 150 and 154 defines a second compartment 156. Openings 158 and 160 can be provided at suitable locations on the device to allow access to said first and second compartments 152 and 156.

Figure 2I:
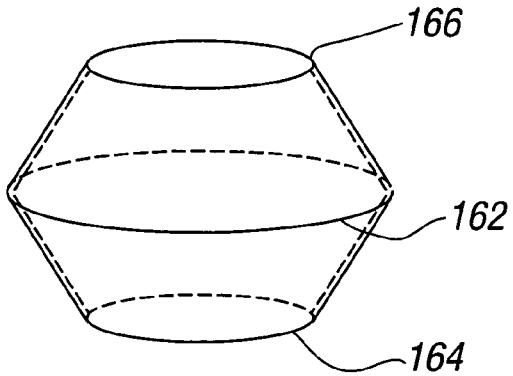
Figure 3A:
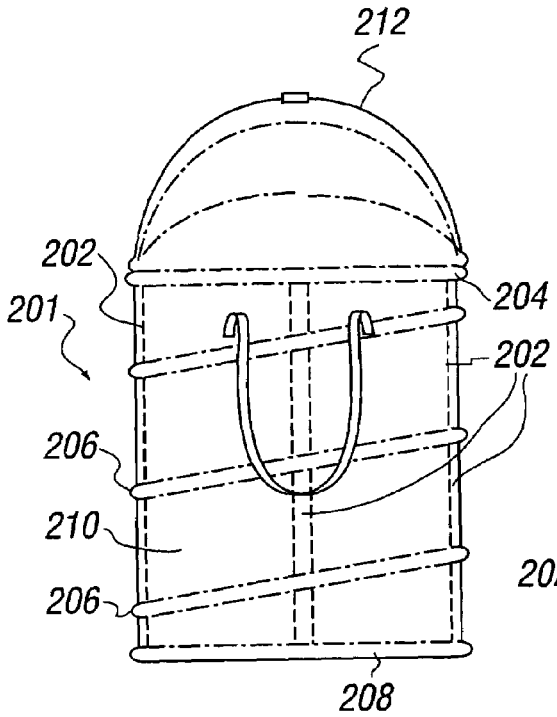
FIGS. 3A–3D illustrate a yet further embodiment of the present invention.
Figure 3B:
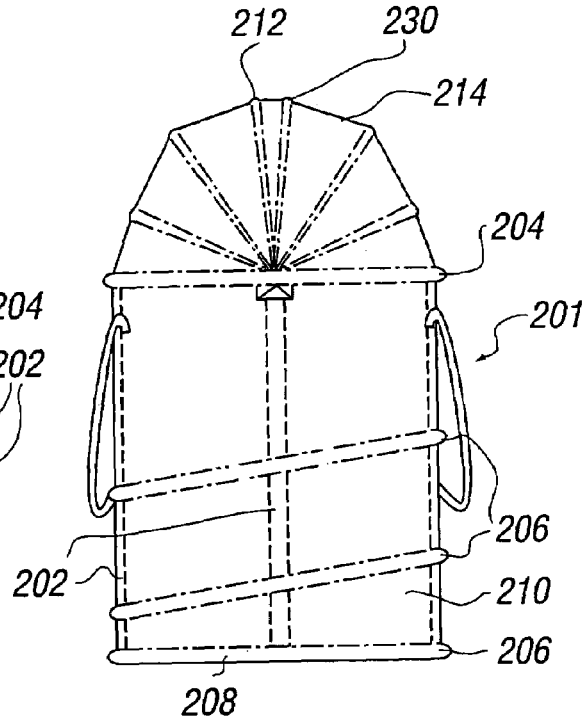
Figure 3C:
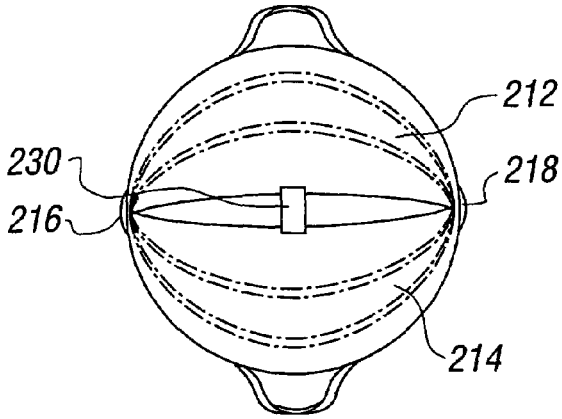
Figure 3D:
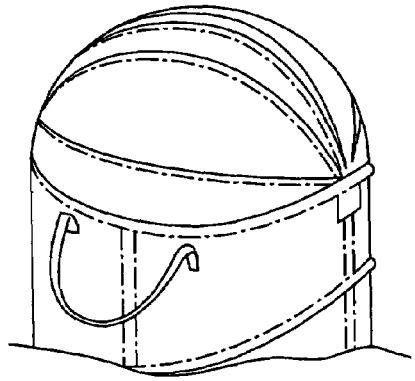

FIG. 2I illustrates a yet further embodiment of the present invention wherein the frame members in the device are of different sizes. Thus, in this example, frame member 162 is of larger cross sectional area than either frame members 164 and 166, thereby giving the device a tapered or barrel shaped appearance.

Referring to FIGS. 3A–3D, there is illustrated a further embodiment of the present invention wherein a storage device 201 is provided. In this embodiment a helical frame member 206 is provided between frame members 204 and 208 forming the top and base of the device respectively. Sheet material 210 is attached between the frame members to form the walls of the device and rod members 202 are located between different portions of the helical frame member 206. In use, a user twists portions of the helical frame member 206 relative to a different portion thereof. This causes the sheet material to twist therebetween and at least part of the device to be flattened. The device 201 is provided with two closure elements 212, 214 which are pivoted about pivot points 216, 218 shown in FIGS. 3C, 4A and 4B in order to close an opening in the device. The two closure elements 212, 214 operate in a similar manner to the closure means shown in FIGS. 1*c*–1*f*. The closure elements are moved between an erect position as shown in FIGS. 3A–3D and a flattened position as shown in FIG. 4B by moving the closure elements in a downwardly and outwardly direction, as shown by arrows 220. In order to close the opening, the closure elements are pivoted in a reverse direction (i.e. in an upwardly direction towards each other).

The sheet material 222 attached between the leading edges 224, 226 and further sub frame members 228 moves with the leading edge between a folded condition, as shown in FIG. 4B, when the closure element is in an open position and a substantially extended or taut condition when the closure element is in a closed position, as shown in FIG. 4A.

Figure 5A:
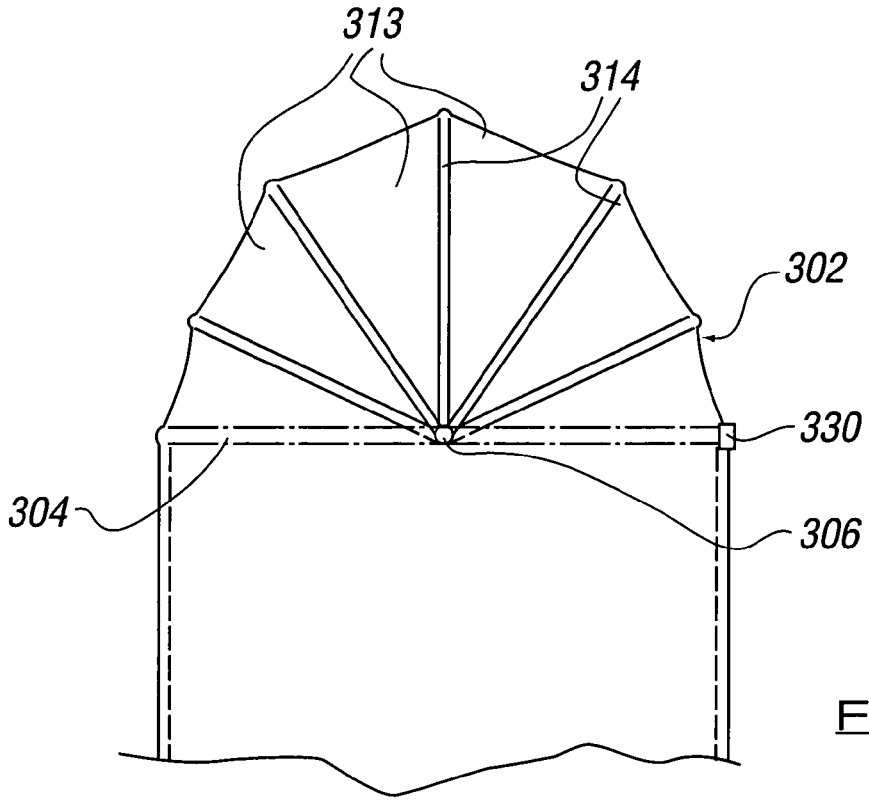
FIGS. 5A and 5B show a detailed view of a closure means according to a further embodiment of the present invention.
Figure 5B:
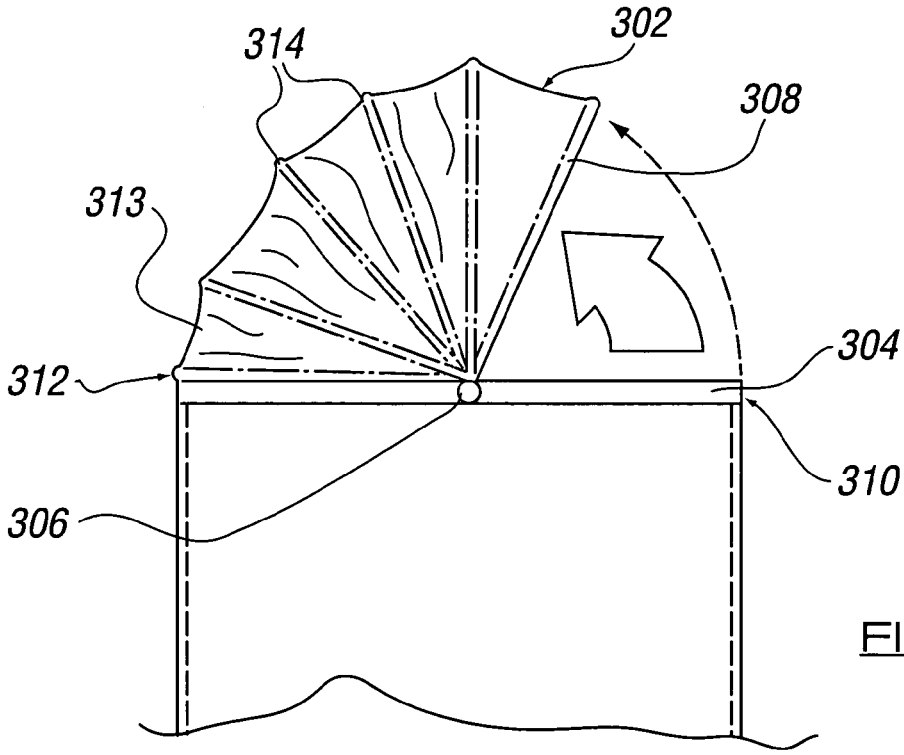

FIGS. 5A and 5B illustrate a closure means comprising a single closure element 302 which is pivotally attached to a frame member 304 at pivot point 306. A leading edge 308 of closure element 302 is movable in an upwardly direction from a first end 310 of the frame member when in a closed position to a second end 312 of the frame member when in an open position. The sheet material 313 attached between the leading edge 308 and further sub frames 314 moves with the leading edge between a folded condition when the closure element is in an open position and a substantially extended or taut condition when the closure element is in a closed position.

Attachment means in the form of a Velcro strap 230, 330 can be provided to secure two closure elements together when in a closed condition or a single closure element to a frame member or side of the device when in a closed condition. Other forms of attachments means can be used, such as a clip, hook, zip and/or the like.

Figure 6A:
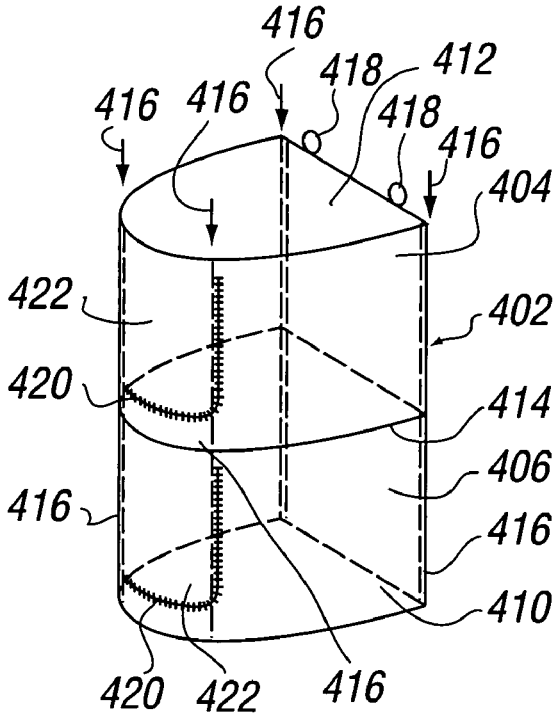
FIGS. 6A–6C illustrate a further embodiment of the present invention.
Figure 6B:
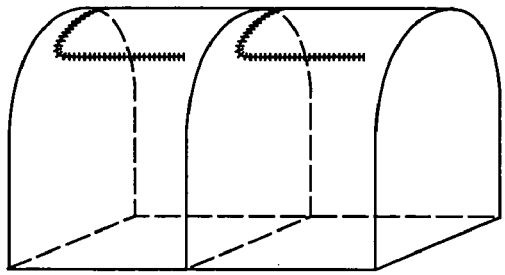
Figure 6C:
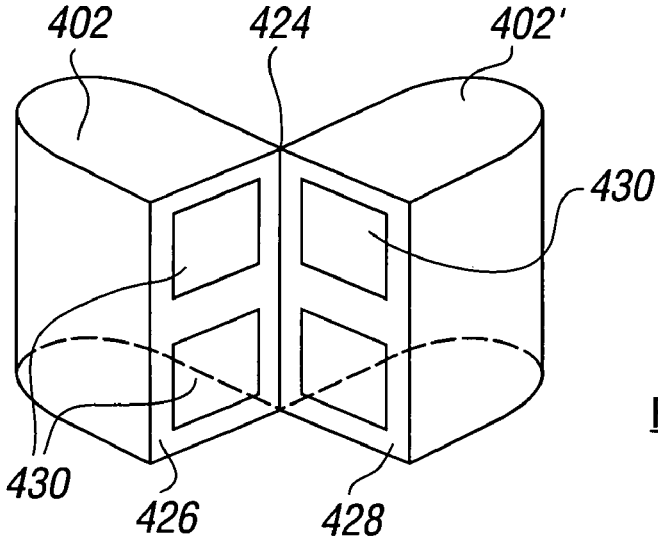

Referring to FIGS. 6A–6C there is illustrated a storage device 402 having two compartments 404, 406 defined by frame means in the form of panels 410 and 412 forming the base and top of the device respectively and panel 414 forming the middle dividing portion. Rod members 416 are provided adjacent the corners of the device and each compartment 404, 406 is collapsed and erected as described above. Hooks 418 are provided along an edge of the device in order to suspend/hang the same from suitable attachment means provided on a wall, post or similar. Closures in the form of hand dividers 420 or sheet material located over openings 422 are provided to allow access to the interior of compartments 404 and 406.

The device 402 can be provided in a vertical orientation, as shown in FIG. 6A, or can be provided in a horizontal orientation, as shown in FIG. 6B. In the latter orientation, the back of the device forms the base of the device. The rod members and panels provide sufficient strength and rigidity to the device to allow the device to be placed in the different orientations.

Two or more storage devices 402, 402' can be joined together by securing means in the form of a hinge 424. The hinge, in one example, is in the form of a bent rod, each end of which is removably located in channels provided on the two devices. The hinge allows the ends of two devices to be pivotally movable between a first closed position, wherein the ends 426, 428 of the devices are adjacent each other, and a second open position, wherein the ends of the devices are a sufficient distance apart to allow a user to access the interior of the compartments via the openings 430 provided on the ends, as shown in FIG. 6C.

In the illustrated embodiment the two devices are hemispherical in shape, such that when the ends of the two devices are brought into engagement together, the resulting storage device is substantially cylindrical in shape. However, it will be appreciated that any number of storage arrangements can be joined together to form any required resulting shape.

Thus it can be seen that any number of frame members and rod members can be used to provide a storage device of a required shape and/or design. The sheet material depending between said frame and rod members can have one or more designs printed thereon to provide a required aesthetic effect. In addition, the storage device can be provided in either a horizontal or vertical orientation.

The present invention provides a quick and easy means of moving a storage device between collapsed and erect conditions. There is no requirement for resiliently biased frame members as in the prior art and thus the present invention is inexpensive to produce compared to said prior art devices.

The invention claimed is:

1. A storage device comprising:

at least first and second frame means and one or more support members for maintaining said at least first and second frame means at a spaced distance apart, said support members and add frame means defining the shape of the storage device, and sheet material depending between said at least first and second frame means and/or said one or more support members forming at least side walls of the device, said device movable between a flattened condition and an erect condition by user manipulation of said frame means, said user manipulation including rotating at least one of said add frame means relative to another of said frame means to twist the device and move the device between said flattened and erected conditions, and wherein when the device is in the collapsed or erect conditions, the support members are substantially straight, wherein the ends of the support members are located in channels and/or pockets on the device and when the device is in an erect condition the channels and/or pockets are spaced a sufficient distance apart to allow the support members to be substantially straight, and wherein when one of the frame means is rotated relative to another frame means, the distance between the pockets or channels housing at least the ends of each support member located between the frame means is initially reduced which causes each support member to be placed under increased tension causing the same to bend or flex.

2. A storage device according to claim 1 wherein when at least one of the frame means is rotated relative to another of the frame means, the rotated frame means is rotated about a substantially central axis thereof.

3. A storage device according to claim 1 wherein the at least first and second frame means are rotated in a substantially opposing direction to each other between said flattened and erect conditions.

4. A storage device according to claim 1 wherein one of the first or second frame means is held in a stationery position and the other of the first or second frame means is rotated relative thereto to move the device between said flattened and erect conditions.

5. A storage device according to claim 1 wherein the one or more support members are formed from a flexible material to allow the flexing thereof when one of the frame means is rotated relative to another of said frame means.

6. A storage device according to claim 5 wherein the support members are resilient so as to return to the substantially straightened condition once force is released therefrom.

7. A storage device according to claim 1 wherein further rotation action causes the distance between the pockets or channels to increase to allow each support member to straighten and resulting in the portion of the device between the frame means to be moved between the erected and collapsed conditions.

8. A storage device according to claim 1 wherein the whole or substantial part of the support members are located in a channel or pocket of sheet material.

9. A storage device according to claim 8 wherein the channel or pockets which house the ends of a support member are located adjacent the respective frame means which are required to be manipulated relative to each other in order to move the device between said erected and flattened conditions.

10. A storage device according to claim 1 characterised in that the support members are elongated in form.

11. A storage device according to claim 1 wherein the first and second frame means form the base and top of the device respectively.

12. A storage device according to claim 1 wherein the first and second frame means form first and second spaced side walls of the device.

13. A storage device according to claim 1 wherein the first and second frame means are substantially rigid.

14. A storage device according to claim 1 wherein the sheet material moves with the frame means and/or support members between said flattened and erected conditions.

15. A storage device according to claim 1 wherein one or more subframe members are provided which are movable independently of said at least first and second frame means and/or support members between said flattened and erect conditions.

16. A storage device according to claim 1 wherein there is provided at least three frame means defining at least two sections within the storage device, each section of the device being collapsed independently of the other section.

17. A storage device according to claim 16 wherein in order to collapse a section of the device one of the frame means are twisted relative to the other of the frame means which defines that section thereby moving that section to a collapsed condition.

18. A storage device comprising:

at least first and second frame means and one or more support members for maintaining said at least first and second frame means at a spaced distance apart, said support members and frame means defining the shape of the storage device, and sheet material depending between said at least first and second frame means and/or said one or more support members forming at least side walls of the device, said device movable between a flattened condition and an erect condition by user manipulation of said frame means, said user manipulation including rotating at least one of said frame means relative to another of said frame means to twist the device and move the device between said flattened and erected conditions, wherein when the device is in the collapsed or erect conditions, the support members are substantially straight, wherein the ends of the support members are located in channels and/or pockets on the device and when the device is in an erect condition the channels and/or pockets are spaced a sufficient distance apart to allow the support members to be substantially straight, and wherein the ratio of the length of the support member and spacing of the pockets or channels for housing at least the ends of the support member is such that the support member is caused to be placed under increased tension on initial relative rotation of the frame means, followed by reduced tension as subsequent increased or decreased rotation of the device takes place.

* * * * *